United States Patent [19]

Leonard

[11] Patent Number: 4,735,599

[45] Date of Patent: Apr. 5, 1988

[54] DRIVE-BELT ASSEMBLY WITH ONE WAY SPRAG-CLUTCH

[76] Inventor: Paul A. Leonard, 3829 Lees Ave., Long Beach, Calif. 90808

[21] Appl. No.: 41,477

[22] Filed: Apr. 23, 1987

Related U.S. Application Data

[62] Division of Ser. No. 906,270, Sep. 10, 1986, Pat. No. 4,681,156.

[51] Int. Cl.[4] ..... F16H 7/08

[52] U.S. Cl. ..... 474/101; 192/45.1

[58] Field of Search ..... 474/101–103, 474/105–108, 111, 136; 192/41 A, 45.1; 188/82.7, 82.8

[56] References Cited

U.S. PATENT DOCUMENTS

| | | | |
|---|---|---|---|
| 2,600,273 | 6/1952 | Seifried | 474/103 |
| 3,651,908 | 3/1972 | Oldfield | 192/45.1 |
| 4,522,353 | 6/1985 | Yeh | 474/106 X |
| 4,635,771 | 1/1987 | Shoji et al. | 192/45.1 X |

*Primary Examiner*—Stephen J. Novosad
*Assistant Examiner*—Thuy M. Bui
*Attorney, Agent, or Firm*—Bruce L. Birchard

[57] ABSTRACT

Cooling apparatus for a gas transmission system which includes radiator fans each driven in a desired direction from its respective drive-motor by way of a drive-belt with an associated belt tensioner, such belt tensioner including a one-way sprag-clutch coupled through a shaft and sheave to a respective drive-belt and having a direction of free rotation which corresponds to the direction of motion of said drive-belt necessary to produce motion of its respective radiator fan in the desired direction.

2 Claims, 1 Drawing Sheet

DRIVE-BELT ASSEMBLY WITH ONE WAY SPRAG-CLUTCH

This is a division of application Ser. No. 906,270, filed 9/10/86 now U. S. Pat. No. 4,681,156.

BACKGROUND OF THE INVENTION

1. Field of the Invention

This invention relates to systems for transmitting gas, particularly natural gas, under pressure throughout a transmission and distribution network, and, more particularly, to an improved method for cooling the gas after its compression and before its transmission to the next leg of the transmission-distribution network.

2. Prior Art

In a transmission system for heating and illuminating gas, such as natural gas, in order to distribute the gas efficiently it is necessary that it be compressed. As is well known, when a gas is compressed, a great deal of heat is generated and, before the gas can be distributed efficiently, it must be cooled, say from 150° F. to 90° F. This cooling step is performed in a cooling tower in which there are fans which are driven through drive-belts from electrical motors, one for each fan. For example, a tower may have 12 fans each 12 feet in diameter and rotating at 268 rpm. In prior art systems, when the requirement for cooling was such that only a portion of the total cooling capacity was required, one or more of the fans in the cooling tower were turned off by switching off the drive-motor associated with each of those fans. Thus, no power was transmitted from the respective electrical motor through its associated drive-belt to the subject fan and the induced draft from the remaining operating fans could cause the idle fans to "windmill" in a direction opposite to that in which they would rotate when driven by their associated electrical motors. Under these conditions, difficulties frequently arose when the motors coupled to the previously idle fans were turned on. For example, the belts between the drive-motors and the sheaves or pulleys on the shafts associated with the fans would jump out of those sheaves or pulleys with the sudden attempt to rotate them in a direction opposite to that in which they were "windmilling". Further, the drive motors had a tendency to draw excessive electrical current during any such sudden attempt to reverse the direction of rotation of the fan blades and there was a corresponding opening of the associated circuit breakers, which then required attention from maintenance personnel. Thrown belts were also experienced and required attention from maintenance personnel.

Therefore, it is a first object of this invention to overcome the various problems recited hereinbefore.

It is a further object of this invention to provide a gas transmission and distribution system and associated apparatus which will cause the cooling fans in the system to rotate in a single direction determined by the drive motor associated with each of the fans.

SUMMARY OF THE INVENTION

The drawbacks of the prior art devices and systems are overcome, and hence, the stated and other objects of the invention are achieved by utilizing in conjunction with each of the drive-belts coupling a drive-motor to a respective cooling fan, a belt tensioner which incorporates a sprag-type, one-direction clutch as an operating part thereof, such clutch permitting rotation of each fan in a single direction determined by the direction of rotation of its associated drive-motor.

BRIEF DESCRIPTION OF THE DRAWINGS

This invention can best be understood by reviewing the description which follows in conjunction with the drawings herein, in which.

DETAILED DESCRIPTION OF THE PREFERRED EMBODIMENT

Figure 1:
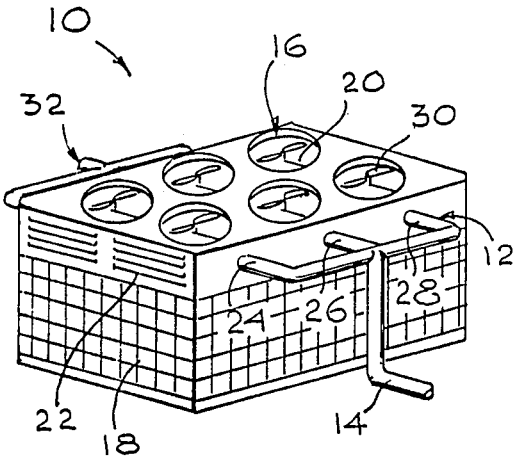
FIG. 1 is an isometric view of a cooling tower for a gas transmission system, according to the present invention.

In FIG. 1, cooling tower 10 includes input manifold 12 coupled through input pipe 14 to one or more gas compressors, not shown. The gas entering through input pipe 14 and manifold 12 has an elevated temperature because of its recent compression by the compressors, not shown. Before it can be distributed it should be cooled so that the volume of gas which can be moved through the associated transmission system is at a practical and economically sound level. Fans 16 driven by electrical motors not shown in this Fig., draw air at ambient temperature into tower 10 through grilled section 18 where it passes over pre-coolers 20 which may be cooled by evaporative cooling. Louvers 22 are provided for introducing air if pre-cooling by pre-coolers 20 is not necessary. Air introduced through entrance 18 or through louvers 22 passes over radiator pipes 24, 26 and 28 and exits by way of fans 30. As a result of the movement of air over the radiator pipes 24, 26 and 28, the hot gas introduced through pipe 14 is cooled and exits at manifold 32 for transmission through the remainder of the transmission system.

Figure 2:
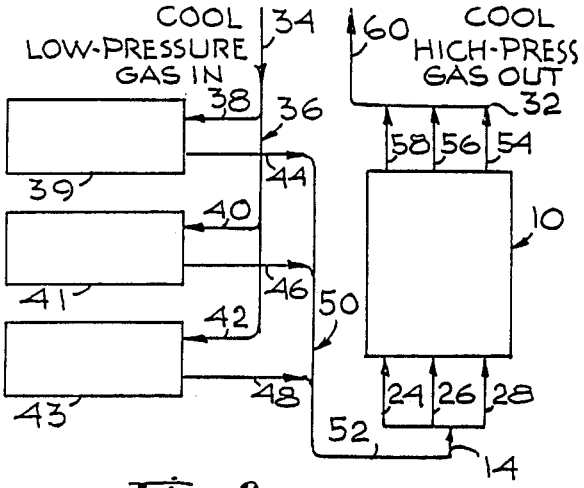
FIG. 2 is a schematic diagram of the embodiment of FIG. 1.

The transmission and distribution system, including the cooling mechanism, is represented schematically in FIG. 2.

In FIG. 2, gas, for example from a storage source or supplier, having a relatively low temperature is introduced through low-pressure gas input line 34 to manifold 36 which distributes the input gas to input lines 38, 40 and 42 of compressors 39, 41 and 43 which produce high pressure, high temperature gas at output lines 40, 42 and 44. Lines 40, 42 and 44 carry such high temperature, high pressure gas to manifold 50, the output of that manifold appearing as high pressure, high temperature gas at output line 52 which is coupled for gas flow to input line 14 of cooling tower 10. Cooling tower 10 outputs cool, high-pressure gas at output lines 54, 56 and 58 which are coupled to manifold 32 and, subsequently, through distribution line 60 to the transmission line which is to carry the compressed gas to the subsequent booster or to the user or users of the gas.

Figure 3:
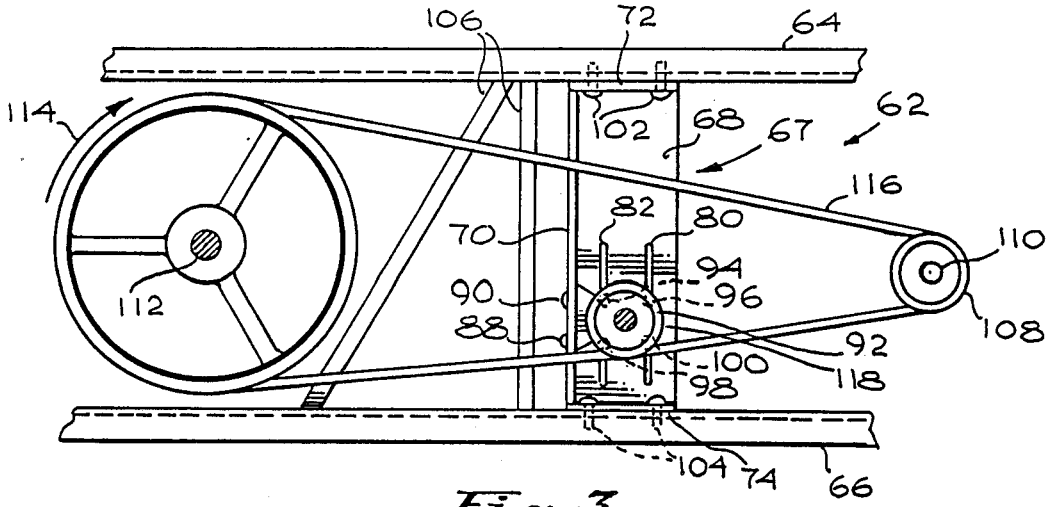
FIG. 3 is a top view of the cooling portion of the gas transmission system, according to the present invention.
Figure 4:
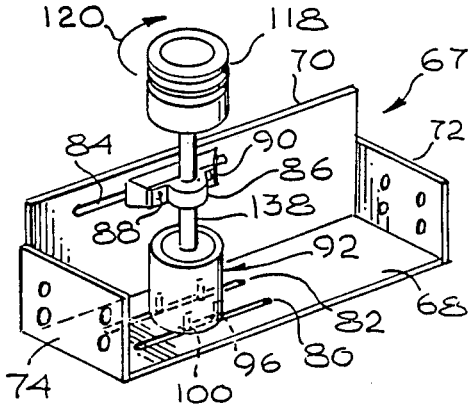
FIG. 4 is an isometric view of a portion of the cooling mechanism of FIG. 3; and, FIG. 5 is a schematic diagram explaining the operation of a portion of the assembly of FIG. 4.

In FIGS. 3 and 4 the mechanism in cooling tower 10 is set forth. Cooling mechanism 62 includes channels 64 and 66 between which there is a support structure 67 having a bottom plate 68, a back plate 70 and two end plates 72 and 74. These elements can be seen more clearly in FIG. 4.

Figure 5:
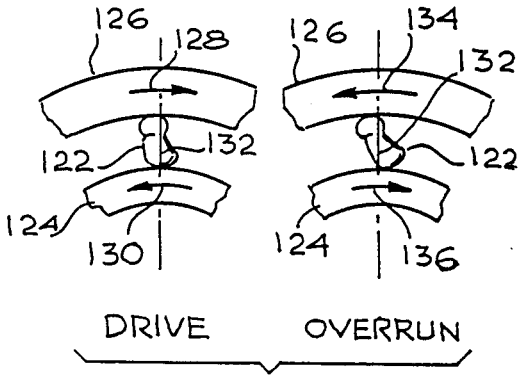

Base 68 has a pair of slots 80 and 82, therein. Back plate 70 has a slot 84, therein. Pillow block or other support 86 is slidably retained in slot 84 by means of bolts 88, 90. One-way sprag clutch 92 is slidably retained in slots 80 and 82 by way of machine bolts 94, 96, 98 and 100. Support structure 67 is secured between channels 64 and 66 by means of machine screws or bolts 102 and 104, respectively, or may be welded in position. Channels 64 and 66 are spaced from each other by means of frame members 106. Motor pulley 108 is supported on motor shaft 110 which is driven by an electrical motor, not shown. Fan 30 is supported on shaft 112 for rotation in the direction indicated by arrow 114. Belt 116 couples driving force from pulley 108 to fan 30 and passes over sheave 118 in the process. When the word "sheave" is used herein it is meant to cover a sheave or a pulley. Sheave 118 is free to rotate in the direction shown by arrow 120 in FIG. 4 but is not free to rotate in the opposite direction. This one-way rotational capability is controlled by the characteristics of sprag-clutch 92. Sprag clutches are available in the marketplace from such companies as Dana Corporation which sells its products under the registered trademark "FORM-SPRAG". A "sprag" is the shaped element 122 in FIG. 5. A sprag-clutch includes a cylindrical inner race and a cylindrical outer race coaxial with the inner race and surrounding it, with an annular space between the two races. Sprags fill the annular space between the inner and outer races. Each sprag is essentially a strut placed between the races in such a way that it transmits power from one race to the other by a wedging action when either race is rotated in the driving direction. Rotation in the other direction frees the sprags and the clutch is disengaged, or overruns. Either race may be the driven member or the driving member. As can be seen from FIG. 5, if outer race 126 rotates in the relative direction of arrow 128 and inner race 124 rotates in the relative direction of 130, sprag 122 tends to align with radial line 132 and, because the length of the sprag 122 has been appropriately chosen, a wedging action occurs causing inner race 124 to be dragged along with outer race 126. Of course there are many sprags within the clutch to distribute the force that must be transmitted between one race and the other.

If outer race 126 (which may be a plurality of ganged races) is rotated in the relative direction of arrow 134 and inner race 124 is rotated in the direction of arrow 136, sprag 122 is caused to move out of alignment with radial line 132 towards a position at right angles thereto resulting in a disengagement of sprag 122 from the surfaces of inner and outer races 124 and 126, respectively, resulting in the free running of each race with respect to the other. This condition is called the "overrun" condition. A "sprag clutch" can be much smaller than other one-way clutches by reason of the packing of the sprags into the space between the outer and inner races and consequent distribution of force. Further, sprags engage both races at constantly changing contact points thus assuring long life for the sprag-clutch.

The desired tensioning of belt 116 is achieved by moving the tensioning assembly comprising sheave 118, sprag-clutch 92 and shaft 138, which supports sheave 118, in slots 80, 82 and 84 until belt 116 has the desired tension. Pillow block 86 is then secured in position in slot 84 by means of bolts 88 and 90 and sprag clutch 92 is secured in position in slots 80 and 82 by means of machine screws 94, 96, 98 and 100. Fan 30 can then only rotate in the direction of arrow 120 and, assuming fan 30 is not being driven from motor pulley 108 by way of belt 116, it cannot reverse its direction because clutch 92 is "grounded" and presents a very high restraining force against rotation in the "windmilling" direction. On the other hand, when belt 116 is causing fan 30 to rotate in the correct direction, shown by arrow 114 in FIG. 3, sprag-clutch 92 is in the "overrun" condition and, as can be seen from FIG. 5, there is no restraining connection between the inner and outer races of sprag-clutch 92 and shaft 138 may rotate freely.

Thus there has been provided improved cooling apparatus for a gas transmission system which will eliminate the problems of belts jumping off of drive pulleys and drive motor deterioration which normally would result when a fan in the system is windmilling and current is applied to its drive-motor. All of that is avoided by utilizing the cooling system set forth in this application.

It should be understood that the use of this invention is not confined to the gas transmission industry but may be applied wherever belt tensioners may be utilized.

While a particular embodiment of this invention has been shown and described, it will be clear to those skilled in the art that variations and modifications may be made in that embodiment without departing from the spirit and scope of this invention. It is the purpose of the appended claims to cover all such variations and modifications.

I claim:

1. For use in a system for the transmission of power from a rotating source to a rotating load by way of a coupling belt, a belt-direction controller and tensioner, including:

adjustable support means for positioning proximate to said coupling belt intermediate said rotating source and said rotating load;

a shaft carried rotatably in said adjustable support means and when, in use, having an axial direction normal to a line of motion of said coupling belt;

a belt-engaging member carried by said shaft and rotatable therewith for engagement with said coupling belt;

a coupling member having first and second concentric cylinders, said first concentric cylinder being coupled to said shaft for rotation therewith and said second concentric cylinder being coupled to said adjustable support means and restrained from rotation thereby; and, a plurality of coupling elements mechanically intercoupling said first and second concentric cylinders in one direction of rotation, only, of said shaft.

2. Apparatus according to claim 1 in which said coupling member is a sprag clutch.

* * * * *